United States Patent [19]

Minikus et al.

[11] Patent Number: 4,832,139

[45] Date of Patent: May 23, 1989

[54] INCLINED CHISEL INSERTS FOR ROCK BITS

[75] Inventors: James C. Minikus, Costa Mesa; Chris E. Cawthorne, Orange, both of Calif.

[73] Assignee: Smith International, Inc., Newport Beach, Calif.

[21] Appl. No.: 60,272

[22] Filed: Jun. 10, 1987

[51] Int. Cl.[4] ..... E21B 10/52; E21B 10/16

[52] U.S. Cl. ..... 175/374; 175/410

[58] Field of Search ..... 175/329, 374, 410, 408, 175/376, 412–413; 51/309; 76/101 E, 108 A; 299/79

[56] References Cited

U.S. PATENT DOCUMENTS

| | | | |
|---|---|---|---|
| 3,442,342 | 5/1969 | McElya et al. | 175/374 |
| 3,495,668 | 2/1970 | Schumacher, Jr. | 175/341 |
| 4,058,177 | 11/1977 | Langford, Jr. et al. | 175/374 |
| 4,086,973 | 5/1978 | Keller et al. | 175/410 |
| 4,108,260 | 8/1978 | Bozarth | 175/374 |
| 4,140,189 | 2/1979 | Garner | 175/410 |
| 4,150,728 | 4/1979 | Garner et al. | 175/410 |
| 4,334,586 | 6/1982 | Schumacher | 175/374 |
| 4,359,335 | 11/1982 | Garner | 175/410 |
| 4,529,048 | 7/1985 | Hall | 175/410 |
| 4,597,456 | 7/1986 | Ecer | 175/410 X |
| 4,722,405 | 2/1988 | Langford, Jr. | 175/410 X |

*Primary Examiner*—Bruce M. Kisliuk

*Attorney, Agent, or Firm*—Robert G. Upton

[57] ABSTRACT

An inclined chisel crested insert is disclosed for use on the gage row of a cone for a rotary cone rock bit. The insert has a different cone angle on opposite sides of the crown of the insert. An elongated conically shaped gage cutting surface of the insert provides point or line contact with a borehole wall as opposed to a full surface contact with the wall as is common with state of the art flat sided gage row inserts. This inclined chisel insert also has advantages over the symmetrical chisel type gage insert in that it is designed to provide increased crest length while providing the desired gage surface angle. The conically shaped gage row inserts with offset chisel crest are less prone to frictional heating due to the point or line contact design. As a result the elongated conical gage cutting surface of the chisel crest insert minimizes gage insert wear and subsequent breakage by eliminating high cycle thermal fatigue.

6 Claims, 4 Drawing Sheets

FIG. 7
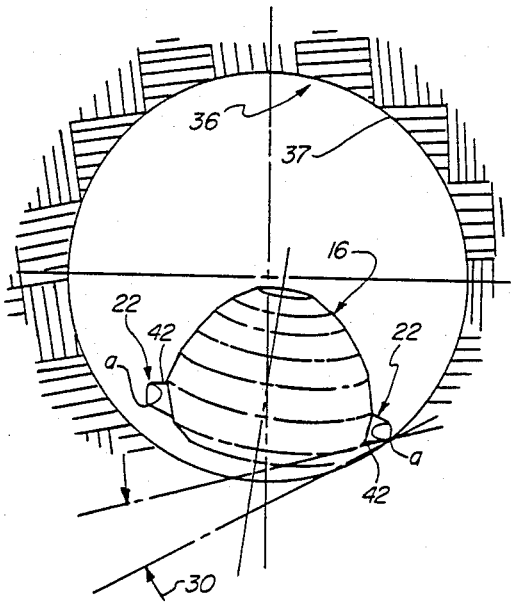
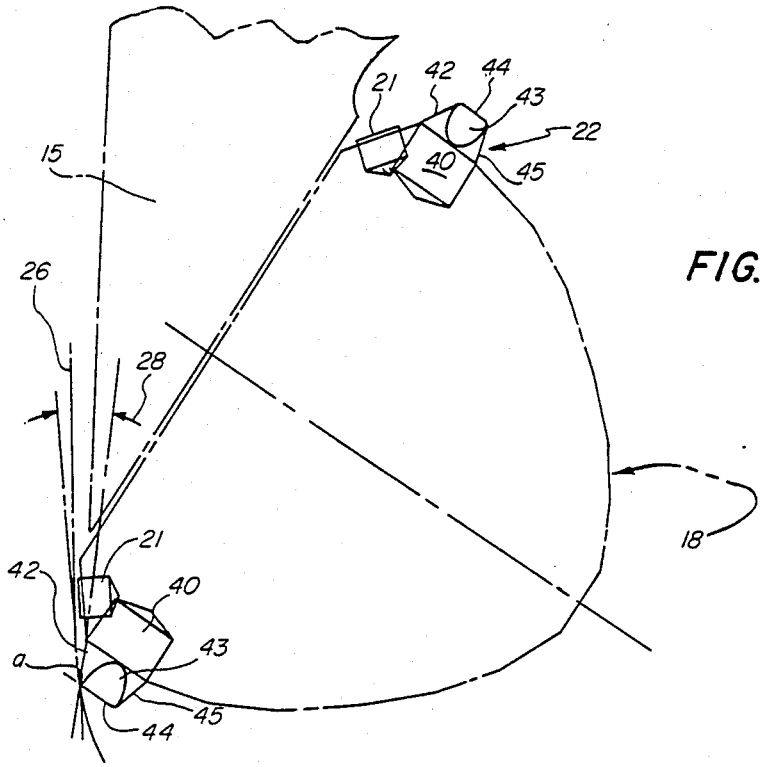
FIG. 6

INCLINED CHISEL INSERTS FOR ROCK BITS

BACKGROUND OF THE INVENTION

1. Field of the Invention

This invention relates to rotary cone rock bits having hard metal cutter inserts strategically positioned within the rotary cones of the rock bit.

More particularly, this invention relates to inclined chisel inserts used particularly in a gage row of a rotary cone for a rock bit.

2. Description of the Prior Art

There are a number of prior art patents that disclose inserts that have certain non-symmetric features. For example, U.S. Pat. No. 3,442,342 discloses a rotary cone rock bit having tungsten carbide chisel inserts in a gage row of each of the three cones. After the bit is assembled, the sides of the gage row inserts are ground flat to the precise gage diameter of the hole to be drilled. The gage row inserts are intentionally installed so that the rock bit, when all three cones are in position, is overgage. The gage row inserts then have to be ground to provide a flat surface so that the diameter of the bit is correct. The patent goes on to teach that if there were no flats on the gage row inserts and the convex surface were simply tangent to a side wall of a borehole, there would be nothing but point contact and the borehole would quickly become undergage as the contact points of the inserts wore away.

It has been determined, however, that gage chisel type inserts having flat spots ground therein provide a relatively large contact area against the borehole sides. Each of the inserts then can be susceptible to heat checking, resulting in premature wear and/or insert breakage. Insert heat checking can be defined as high cycle thermal fatigue due to intermittent frictional heat generated by borehole wall to gage insert contact and subsequent cooling by drilling fluid per each revolution. Certain formations such as shales can generate inordinate amounts of frictional heat at the borehole wall-/gage insert interface. If the cobalt contents of the tungsten carbide alloy inserts is reduced or the tungsten carbide grain size is adjusted to reduce the tendency to heat check (independent of geometry change), then typically, the fracture toughness of the insert is reduced and the design is more susceptible to pure mechanical fatigue failure.

U.S. Pat. No. 4,058,177 describes a non-symmetric gage row insert which provide a large wall contacting surface supposedly decreasing the wear on the gage insert because of the larger contact area and increasing the ability of the earth boring apparatus to maintain a full gage hole. The insert has a shape prior to assembly onto the rock bit apparatus that includes a base integrally joined to a non-symmetric head. The base is mounted within the cone and the head projects from the rock bit cone and includes an extended gage cutting surface that is flat. The gage cutting surface contacts the wall of the hole with the majority of the length of its extended surface.

This patent, like the foregoing patent, provides a gage row insert with a large flat surface that parallels the borehole wall and thus is subject to the same insert degradation as the foregoing patent.

Another U.S. Pat. No. 4,108,260, describes specially shaped non-symmetrical inserts to be used in rotary cone rock bits. The insert is generally chisel-shaped with flanks converging to a crest. The flanks are non-symmetrical with respect to each other, the leading flank is scoop-shaped and the trailing flank is rounded outwardly. This insert is designed for increased penetration in a rock formation. The insert is not, however, designed specifically for a gage row of a rock bit to maintain the gage of the bit as it is used in a borehole.

Still another prior art U.S. Pat. No. 4,334,586, describes inserts for drilling bits. The insert cutting elements comprise non-symmetrical inserts placed in at least one circumferential row in a roller cone in alternating alignment. This non-symmetrical type insert is cone-shaped with the apex of the insert rounded and off-center. Each insert in the circumferential row is alternated so that its apex is not aligned with its neighboring insert, every other insert being so arranged in rows on a rotary cone of a rock bit.

This non-symmetrical insert, like the foregoing insert, is not designed to be placed in a gage row of a cone to provide maximum gage protection during bit operation in a borehole.

The foregoing prior art patents are disadvantaged, especially those patents that teach a flattened area to be positioned adjacent a gage row of a rotary cone. The large area flat surface paralleling the wall of a borehole makes the gage row inserts susceptible to heat checking thereby prematurely wearing the insert and, in many cases, causing the insert to fracture through thermal fatigue failure. When this occurs the rock bit quickly goes undergage, creating all kinds of problems for subsequent new bits that are placed back into the borehole for further penetration of a formation. If a dull bit is undergage when removed or "tripped" from the borehole, a following new full gage bit will immediately pinch, forcing the cones inwardly towards each other and rendering the bit useless thereafter. The remedy is a costly reaming operation to bring the borehole back to gage.

Symmetrical chisel type inserts are sometimes used on gage and they do provide a conical rather than flat gage cutting surface adjacent to the borehole wall. However, the cutting surface of these inserts often does not closely parallel the borehole wall, therefore allowing the bit to go undergage much earlier. When the cone angle of a standard chisel insert is increased to improve the gage surface angle (or the angle between the side of the cone and the borehole wall), the extension of the insert becomes limited because the crest length decreases as the insert extension increases. Therefore, a special non-symmetrical insert is designed to provide increased crest length while providing the desired gage surface angle, thus providing maximum gage-keeping capability while minimizing wear on the special non-symmetric inserts as taught in the present invention. It has been found that conical-shaped gage cutting surfaces provide a more desirable line or point contact rather than a full surface, large area contact like a gage chisel insert having a flat side as indicated in the foregoing prior art. The conically shaped gage cutting surface reduces the possibility of heat checking that can lead to catastrophic failure of the insert. In other words, it is desirable to have a design balance between the thermal fatigue associated with heat checking and the mechanical fatigue associated with insert shape and respective strength.

SUMMARY OF THE INVENTION

It is an object of this invention to provide a gage row insert for rotating cones of a rotary cone rock bit which balances maximum gage-keeping capabilities with minimum wear on the gage row inserts.

More specifically it is an object of this invention to provide non-symmetrical chisel type gage row inserts wherein the gage cutting surface, being rounded, more closely parallels the wall of the borehole which will keep the bit in gage after some wear of the gage row inserts has occurred.

A hard metal gage row insert for a roller cone rock bit is disclosed which consists of a generally cylindrical base portion at one end of the insert. The base portion of the insert is inserted into an insert hole formed by the cone, the insert forming an elongated crest portion at an opposite cutting end of the insert. The insert has to different conical surfaces on opposite sides of the elongated chisel crest. A first elongated conical surface is a gage cutting surface adapted to be in contact with a borehole wall formed in a formation by the rock bit. A second conical surface on an opposite end of the elongated chisel crest serves to support the chisel crest. The conical surface of the elongated gage cutting side of the insert is oriented with respect to the borehole wall such that the elongated conical surface makes, substantially, an initial point or line contact with the borehole wall prior to any wear of the insert during rock bit operation. The angle between the elongated conical gage cutting surface and the borehole wall may be between zero degrees and twenty-five degrees. The preferred angle between the conical gage cutting surface and the borehole wall is about at the midpoint between these two angles.

An advantage, then, of the present invention over the prior art is the elongated conical gage cutting surface adjacent the borehole wall. Moreover, the inwardly facing, non-gage cutting, conical surface, adjacent the crest of the insert has a different conical surface than the conical surface of the elongated gage side, thereby allowing the insert to have a longer crest length. The non-symmetrical crested gage insert provides a more aggressive and less fragile looking insert as well as better bottom hole coverage.

The above noted objects and advantages of the present invention will be more fully understood upon a study of the following description in conjunction with the detailed drawings.

BRIEF DESCRIPTION OF THE DRAWINGS

FIG. 6 is a partially cut away side view, partially in phantom outline, illustrating gage row inserts of the present invention;

FIG. 7 is a view of a borehole in an earth formation looking up at one of three rotary cones of a rock bit, partially in phantom, illustrating a gage row insert of the present invention in contact with the wall of the borehole;

DESCRIPTION OF THE PREFERRED EMBODIMENTS AND BEST MODE FOR CARRYING OUT THE INVENTION

Figure 1:
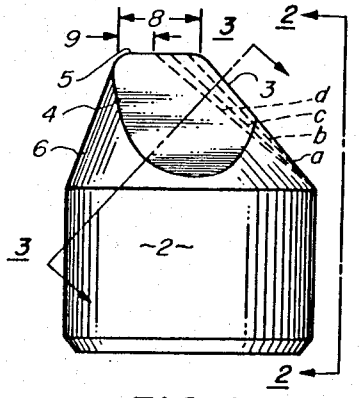
FIG. 1 PRIOR ART
FIG. 1 is a side view f a prior art insert.

FIG. 1 illustrates a prior art gage row chisel insert. The insert consists of a crest 5, a conical back surface 6, flat sides 4 and flat cutting surface 3. The prior art insert, before use, has a crest length 8. As the insert is worn during operation of the roller cone rock bit in a borehole, the flattened cutting surface 3, is progressively worn along dotted surfaces "b", "c" and "d". Surface "a" is the original flattened cutting surface prior to rock bit use. As is readily apparent, the crest length 8 becomes narrower as the bit is worn down towards surface "d" resulting in a crest length 9 which is relatively small and fragile. When the prior art insert reaches this worn condition the shortened crest length easily breaks off resulting in catastrophic failure of the insert.

Moreover, when tungsten carbide pieces mix in with the cuttings from the borehole bottom, the entire bit is in jeopardy oftentimes resulting in more broken inserts, or worse yet, loss of a cone on the bottom of the borehole. "Fishing" operations (retrieval of bit parts from the borehole bottom) are expensive and result in nonproductive downtime for the rig operators.

Figure 2:
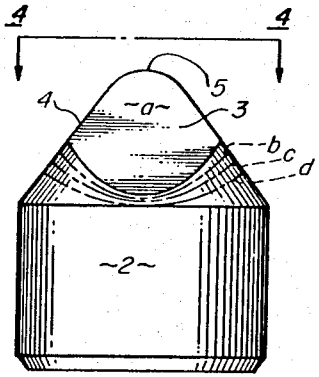
FIG. 2 PRIOR ART
FIG. 2 is a front view taken through 2—2 of FIG. 1.

FIG. 2 shows the cutting face 3 of the prior art insert before use. Surface 3, is relatively large and is oriented parallel or adjacent to a borehole wall during operation of the rock bit in a borehole. The insert is subject to frictional heat build up since there is a large surface area in contact with the borehole wall. As the insert wears during use the surface "a" becomes larger as it approaches condition "b", "c" and "d". This enlargement of the already enlarged cutting surface results in even greater frictional heat build up which, of course, accelerates failure of the inserts through thermal fatigue.

Figure 3:
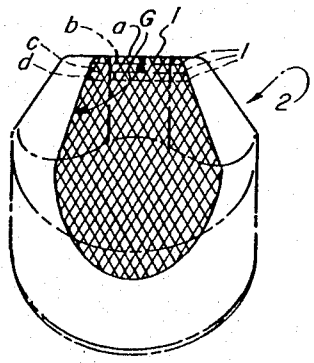
FIG. 3 PRIOR ART
FIG. 3 is an oblique sectional view taken through 3—3 of FIG. 1.

FIG. 3 is an oblique section taken through FIG. 1 to show the sharp-angled corner 1 which transitions from the cutting face 3 to the insert sides 4 on either side of the crested ridge 5. The sharp corner 1 is present through all stages of wear of "b", "c" and "d" and results in chipping and cracking along this vulnerable edge during the working of the rock bit in a borehole. The included angle between cutting face 3 and insert sides 4 is about 110 degrees, resulting the sharp corner 1.

Figure 4:
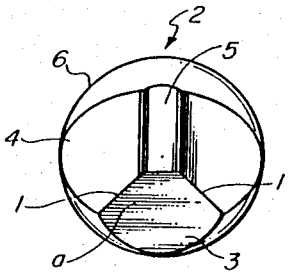
FIG. 4 PRIOR ART
FIG. 4 is a top view of the prior art insert taken through 4—4 of FIG. 2.

FIG. 4 illustrates the broad contacting surface 3, and the sharp-angled corners 1, which intersects into the side flats 4 of the prior art insert 2.

Figure 1A:
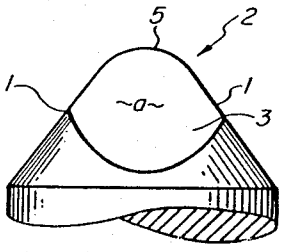
FIG. 1A PRIOR ART
FIGS. 1A through 1D are partially cut away front views of the prior art insert of FIG. 1 that is gradually worn down against the borehole wall through stages "b", "c" and "d"
Figure 1B:
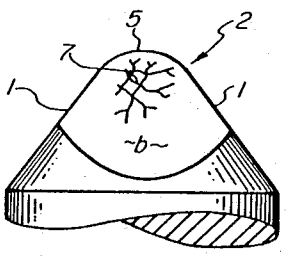
FIG. 1B PRIOR ART
Figure 1C:
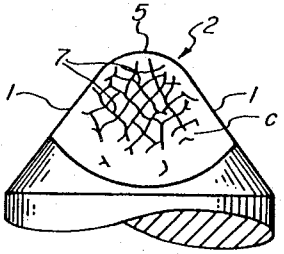
FIG. 1C PRIOR ART
Figure 1D:
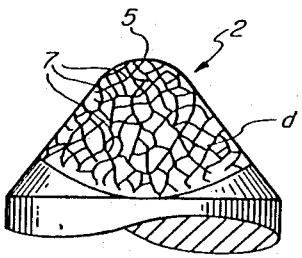
FIG. 1D PRIOR ART

The prior art FIGS. 1*a* through 1*d* illustrate the cutting surface 3 as it transitions through the various stages of wear. For example, in FIG. 1*b* the area "b" is widened with respect to the new surface "a" of FIG. 1*a*. In addition, the surface begins to heat check at location 7 near the center of worn surface "b". FIG. 1*c* shows a progression of wear "c" with the wider surface area and pronounced heat checking 7. Finally, the prior art FIG. 1*d* shows an extremely worn surface "d" that is thoroughly heat checked. The crest 5 is shortened and in danger of breaking off as is illustrated in the prior FIG. 1.

The foregoing prior art gage row insert illustrated in FIGS. 1 through 4 and FIGS. 1*a* through 1*d* clearly illustrate the degradation of these full contact inserts. The pronounced heat checking caused by the frictional heating of the enlarged areas 1*a* through 1*d* against the borehole wall is a major contributor to the early failure of rock bits incorporating these types of gage row inserts. Attempts to correct the heat checking through adjustments in tungsten carbide particle grain size or cobalt content, can create inserts that also have low fracture toughness values leading to increased mechanical fatigue failures.

Figure 5:
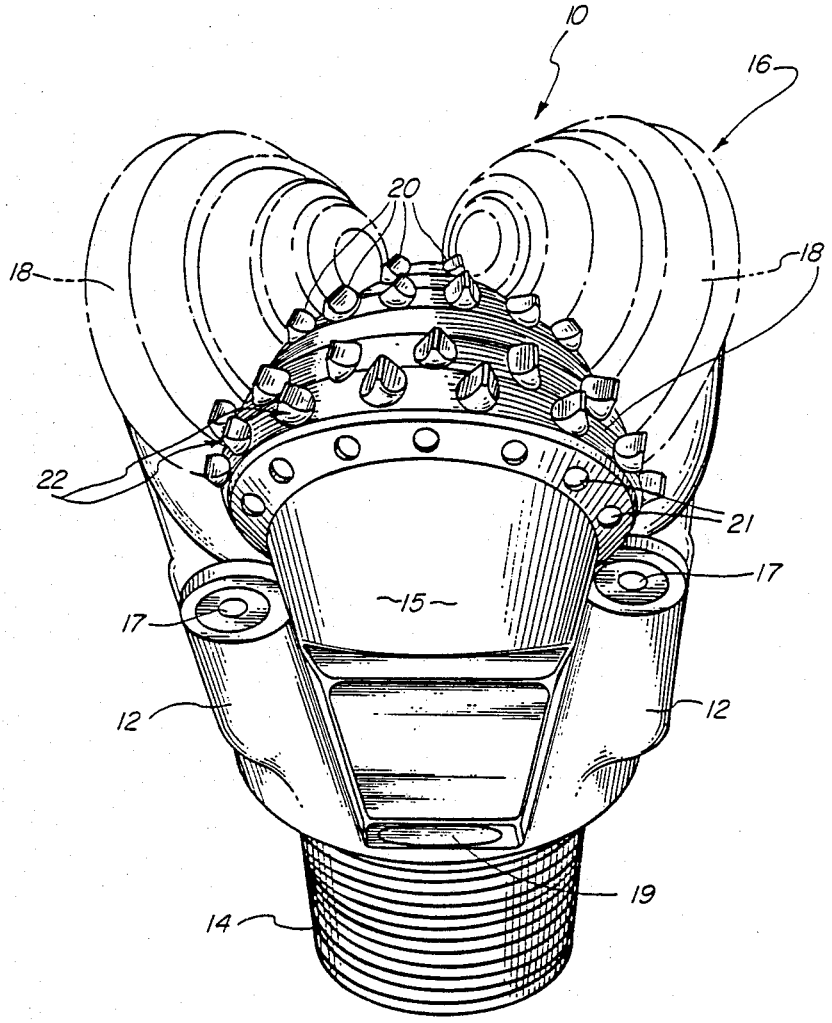
FIG. 5 is a perspective view of a rotary cone rock bit, partially in phantom outline, illustrating a rotary cone with cutter inserts embedded therein.

The perspective view of FIG. 5 illustrates a 3-cone rock bit. The rock bit generally designated as 10 consists of a bit body 12 having a pin end 14 at one end and a cutting end generally designated as 16 at the other end. A rotary cone 18 is rotatively connected to a thrust bearing journal which is cantilevered inwardly from a rock bit leg 15 (not shown). The cone 18 has, for example, a multiplicity of tungsten carbide cutter inserts 20 interference fitted into holes drilled in the surface of the cone 18 (not shown). A series of gage row inserts 22 are pressed into holes drilled into an annular surface formed by the cone. The gage row inserts 22 contact the borehole wall and ultimately determine the diameter of the borehole. A series of flush type button inserts 21, for example, may be pressed into the base of the cone. These inserts reinforce the gage row of the cone and serve to prevent degradation of the cone while it works in the borehole.

Nozzle 17 provided in the bit body 12 directs hydraulic fluid toward the borehole bottom and serves to sweep detritous from the borehole and to clean and cool each of the cutter cones 18. In sealed bearing rock bits a lubrication chamber 19 is formed in each leg and serves to supply lubricant to the bearing surfaces formed between a journal and the cone 18 (not shown).

Turning now to FIG. 6, a partially cutaway rock bit leg 15 supports a cone 18 which is rotatively secured to a journal bearing cantilevered from the leg 15. The gage row inserts of the present invention, generally designated as 22, are pressed into the gage row of the cone 18 with a cutting surface 42 facing towards the borehole or gage curve 26. The base 40 of insert 22 is typically interference fitted within a hole drilled into the gage row of cone 18. The extended portion of the insert 22 is inclined or non-symmetrical and comprises an elongated conical cutting surface 42, a crest 44 and a conical back surface 45. The sides 43 of the insert are substantially flat and terminate at crested surface 44 of the insert 22. The conical cutting surface 42 is longer than the back conical surface 45. The angle with respect to a centerline of the insert is greater along the conical cutting surface 42 (hence longer) than the angle of back conical surface 45. The cutting surface 42 intersects a "gage curve" 26, and determines the diameter of a hole the rotary cone cutter cuts.

A gage curve is a tool that rock bit engineers use to determine that the bit design in question will cut a specified hole diameter. A gage curve is defined as follows:

For a bit of a given diameter, journal angle and journal offset, all the points that will cut the correct size hole projected into a plane through the journal centerline and parallel to the bit center. The foregoing definition is complicated by the fact that most rock bits utilize rotating cones that are offset from a true radial line emanating from the centerline of the rock bit. This parameter coupled with an oblique angle of the journal as is cantilevered off of the rock bit legs necessitates the use of the foregoing formulation to determine exactly where the gage row inserts will contact the borehole. Hence, the angle formed between the elongated cutting surface 42 of the insert 22 and the gage curve 26 should be an angle indicated as 28 that is between 0 degrees and 25 degrees. More specifically, this angle is optimized near the midpoint between these two angles.

To put it another way, FIG. 7 illustrates a single cone shown in phantom as it is viewed when looking up a borehole at the bit. As stated before the gage row containing the gage row inserts 22 of the present invention establishes the diameter of the borehole 36. The cutting surface 42 of insert 22 contacts the borehole wall 37 at point "a" and the angle 30 between the borehole wall 37 add elongated cutting surface 42 is between 0 degrees and 25 degrees. The preferred angle being near the midpoint. This angulation (0° to 25°) between the gage row cutting surface 42 and the borehole wall has been determined to provide the best angle of the point contact of cutting surface 42 with the borehole wall 37.

By providing essentially a point contact "a" on an elongated rounded conical surface 42, the wear of the insert is minimized since surface 42 is not flat. Even if elongated conical surface 43 is in full contact with a borehole wall (0 degree angulation between surface 42 of insert 22 and borehole wall 37) a line contact only would occur between the two surfaces, thereby greatly reducing the area of contact and the inherent frictional heat generation problems that result therefrom (not shown). To further clarify this aspect of th preferred embodiment, reference is now made to FIGS. 8, 9, 10 and 11, as well as FIGS. 8*a* through 8*d*.

Figures 8, 8A, 8B, 8C, 8D, 9, 10, 11:
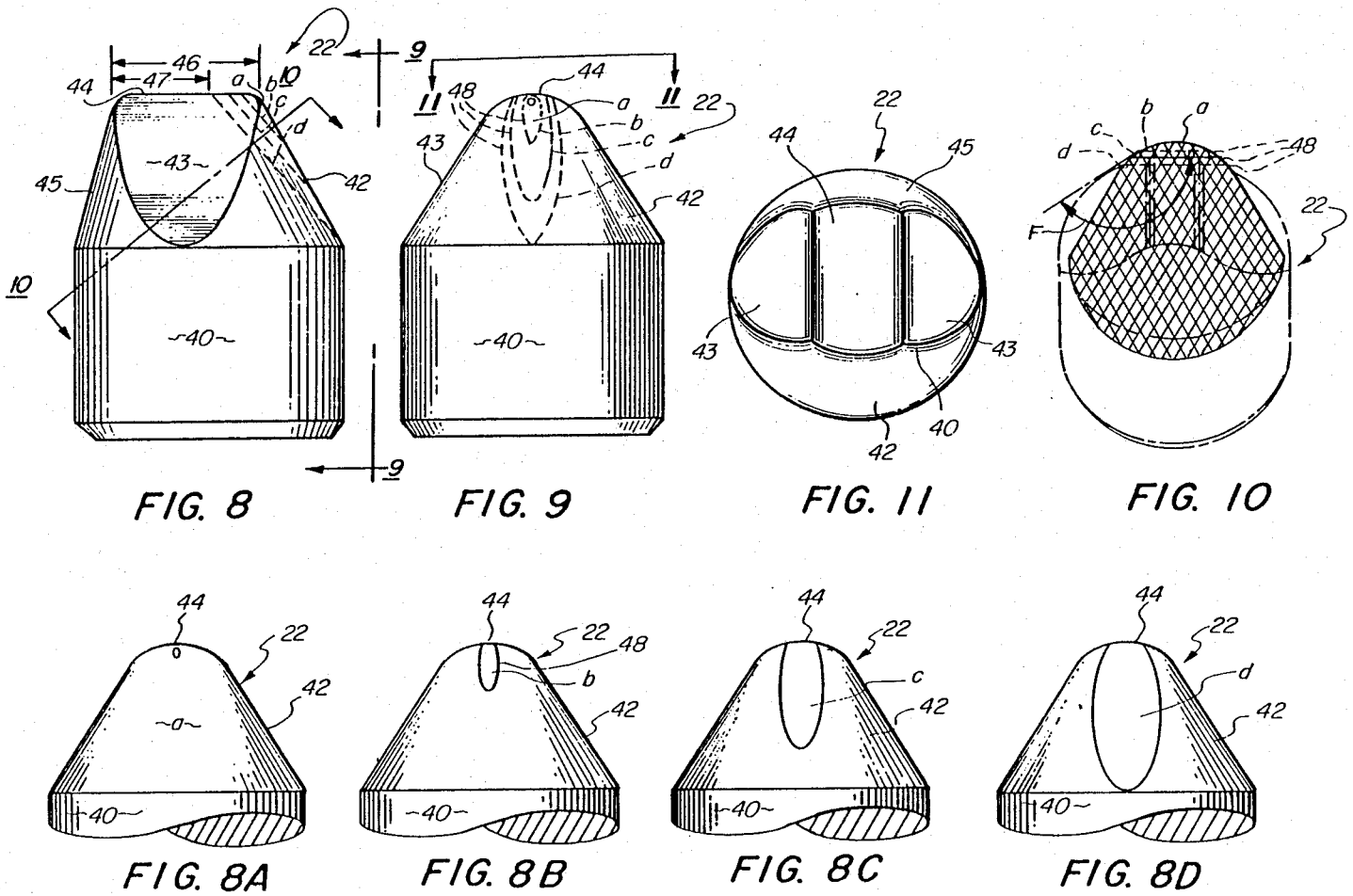
FIG. 8. is a side view of a preferred embodiment of an insert of the present invention.
FIGS. 8A through 8D are partially cut away front views of the insert of FIG. 8 that is gradually worn down through stages "b", "c" and "d"
FIG. 9 is a front view taken through 9—9 of FIG. 8.
FIG. 10 is an oblique sectional view taken through 10—10 of FIG. 8.
FIG. 11 is a top view of the insert of the present invention taken through 11—11 of FIG. 8.

Referring now to FIG. 8 an insert of the preferred embodiment is shown and designated generally as 22. Insert 22 consists of base portion 40, the cutting end of the insert comprising an elongated conical cutting surface 42, side surfaces 43 and conical back surface 45. The insert projection terminates at a rounded crest or crown portion 44. The elongated conical cutting surface 42 makes an initial contact with a borehole wall 37 (FIG. 7) at surface "a" and as the insert works in the borehole it is worn through dotted surfaces "b", "c" and "d". As the insert wears from surface "a" through surface "d", the crest length 46 is reduced to crest length 47. (Crest length 47, however, is much longer than the crest length of a standard symmetrical chisel insert with the same conical gage cutting surface. This is due to the fact that the insert 22 is non-symmetrical, the shortened conical backface 45 permitting the crest length 44 to be essentially longer in length.) Consequently, when the insert reaches the worn position "d" there is sufficient crest length 47 to adequately support the insert even though it is at an advanced state of wear.

Referring now to FIG. 9, the insert is rotated 90° so that we are now looking at the elongated cutting surface 42. In this view it is readily apparent that surfaces from "a" through "d" are much smaller in area than those surfaces depicted in the prior art FIGS. 1 through 4. Consequently, even though the insert wears, the worn surface area is smaller (more like a line contact) than the surface area of the prior art insert; hence, heat checking and fracturing of the insert is much more minimized. In addition, the corners 48 created between the worn surface and the conical surface 42 are much less severe.

Referring now to FIG. 10, it can be seen through this oblique section taken through FIG. 8 that the corners 48 are very gentle and less severe than corners 1 of FIGS. 1 through 4. The included angle "f", for example, formed between progressively worn surfaces "b", "c" and "d" and elongated conical surface 42 is about 145 degrees. The included angle may be between 114 degrees and 170 degrees. The included angle G of the prior art insert shown in FIG. 3, for example, has an included angle of about 110 degrees and is much more vulnerable to chipping and cracking as a result as heretofore described. Consequently, it is quite apparent that there is very little chance of the insert chipping or failing along this intersection between worn surfaces "b" through "d" and the elongated conical, or rounded surface 42 of insert 22.

FIGS. 8*a*, 8*b*, 8*c* and 8*d* depict the insert through various stages of wear. FIG. 8*a* illustrates the elongated conical surface 42 of insert 22 with the initial point "a" in contact with a borehole wall 37 (FIG. 7) FIG. 8*b* shows the insert with a little bit of wear "b" that is devoid of sharp, angular corners typical of the prior art of FIGS. 1 through 4. FIG. 8*c* shows worn surface"c" which is still small in area. Since surface "c" is small in area it is not as subject to heat degradation as the prior art inserts. Finally, FIG. 8*d* shows an insert that is considerably worn yet, surface "d" is much smaller in area than surface "d" of FIG. 1*d*; hence, while the surface is worn the integrity of the insert of the instant invention is maintained because very little of the insert is worn away due to the line contact nature of the cutting surface 42. The gentle or less severe corners 48, also serve to maintain the integrity of the insert as it wears from surface "a" to surface "d" virtually eliminating catastrophic failures of the gage row inserts 22 as they are working in a borehole.

The gage row inserts 22 may be of the enhanced type wherein the non-symmetrical insert is crowned with a layer of diamond (not shown). Such enhanced inserts are the subject of U.S. Pat. No. 4,604,106 entitled Composite Polycrystalline Diamond Compact assigned to the same assignee as the present invention.

Moreover, the conically shaped non-symmetrical gage surface illustrated in FIG. 8 of the preferred embodiment is uniquely suited to the foregoing invention point or line contact with a borehole wall). It is well known by the diamond cutting insert manufacturers that full contact with a gage surface will create heat that is detrimental to a diamond cutting surface. The use of a diamond coated gage row insert of the present invention, wherein point contact conical gage surfaces are employed, virtually assures maintainance of the full gage dimater of the borehole since diamond surfaces do not wear or disintegrate when heat generation is controlled. These enhanced diamond layered inserts may be obtained from Megadiamond of Provo, Ut., a subsidiary of Smith International, Inc.

The preferred embodiment (FIG. 8) of gage row insert 22, while at first glance does not appear to be much different than the prior art inserts, is surprizingly different in performance. The affect of the elongated conical surface 42 as it works in a borehole and the angle at which surface 42 contacts the borehole wall is dramatically different than the inserts of the prior art. Thus, the insert of the instant invention is far superior to that illustrated in the prior art. Furthermore, the present invention teaches away from the principals set forth in the prior art.

The principles taught in this invention may be utilized in borehole cutting tools other than rotary cone rock bits. For example, insert 22 may be employed in a drag bit or hole opener commonly employed in the petroleum industry.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A roller cone rock bit having cones, the cones having multiple gage row as well as other inserts to form a substantially circular borehole in a formation, the borehole having a substantially cylindrical side wall, said gage row inserts comprising:

a generally cylindrical base portion formed at one end of said insert, said base portion is inserted into an insert hole formed by the cone and an elongated chisel crest portion formed at an opposite cutting end of said insert from said base portion, said insert at said opposite cutting end having two different conical surfaces on opposite ends of said elongated chisel crest, a first elongated conical surface extending from said base portion above a surface of said cone is a gage cutting surface adapted to contact said cylindrical borehole wall formed in said formation by said rock bit, a second conical surface extending from said base portion on an opposite end of said elongated chisel crest serves to support, on an opposite end of said chisel crest, the elongated conical gage cutting surface of said insert being oriented with respect to the cylindrical borehole wall such that said first elongated conical surface makes substantially point contact with said cylindrical borehole an initial wall prior to any wear of said insert during rock bit operation.

2. The invention as set forth in claim 1 wherein an angle between said first elongated conical gage cutting surface of said insert and said cylindrical borehole wall is between 0 degrees and 25 degrees.

3. The invention as set forth in claim 2 wherein the angle is about midway between 0 degrees and 25 degrees.

4. The invention as set forth in claim 1 wherein the first elongated conical gage cutting surface of said insert extending from said base portion above said surface of said cone is longer in length than said second opposite conical surface extending from said base portion adjacent said elongated chisel chisel formed by said cutting end of said insert.

5. The invention as set forth in claim 1 wherein after said gage row insert works in said cylindrical borehole for a period of time to cut the borehole diameter in said formation, an included angle formed between a worn substantially flat surface formed on said first elongated conical gage cutting surface positioned immediately adjacent the wall of said borehole and the rounded, unworn elongated conical gage cutting surface of the gage insert is between 114 degrees and 170 degrees.

6. The invention as set forth in claim 5 wherein said included angle is about 145 degrees.

* * * * *